US010840641B2

(12) United States Patent
Aoshima et al.

(10) Patent No.: US 10,840,641 B2
(45) Date of Patent: Nov. 17, 2020

(54) CONNECTOR

(71) Applicant: Yazaki Corporation, Tokyo (JP)

(72) Inventors: Kengo Aoshima, Kakegawa (JP); Takao Murakami, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/449,790

(22) Filed: Jun. 24, 2019

(65) Prior Publication Data

US 2020/0014146 A1 Jan. 9, 2020

(30) Foreign Application Priority Data

Jul. 6, 2018 (JP) ..... 2018-129121

(51) Int. Cl.
*H01R 13/629* (2006.01)
*H01R 13/627* (2006.01)

(52) U.S. Cl.
CPC ... *H01R 13/62944* (2013.01); *H01R 13/6275* (2013.01); *H01R 13/6295* (2013.01); *H01R 13/62938* (2013.01); *H01R 13/62955* (2013.01)

(58) Field of Classification Search
CPC ..... H01R 13/62938; H01R 13/62955; H01R 13/62944; H01R 13/6275; H01R 13/6295
USPC ..... 439/157, 372
See application file for complete search history.

(56) References Cited

U.S. PATENT DOCUMENTS 4,152,038 A * 5/1979 Inouye ..... H01R 13/629 439/153
5,110,301 A * 5/1992 Inoue ..... H01R 13/62944 403/322.1
5,928,012 A * 7/1999 Kitamura ..... H01R 13/62977 439/157
6,375,481 B2 * 4/2002 Zweigle ..... H01R 13/62977 439/157
7,744,390 B2 * 6/2010 Tyler ..... H01R 13/62927 439/157
9,917,402 B1 * 3/2018 Campbell ..... H01R 13/62911
2006/0281351 A1 12/2006 Yamaoka
2007/0026705 A1 2/2007 Tyler
(Continued)

FOREIGN PATENT DOCUMENTS

JP 2006-344473 A 12/2006
JP 2009-503783 A 1/2009
(Continued)

*Primary Examiner* — Hien D Vu
(74) *Attorney, Agent, or Firm* — Sughrue Mion, PLLC

(57) ABSTRACT

A connector includes a second housing fittable with a first housing, a slide member movable relative to the first housing along a connector fitting direction, a transmission gear member rotatably supported by a support shaft provided on the first housing, a first rack gear portion provided on the slide member along the connector fitting direction, a driven gear portion of the transmission gear member rotated by movement of the first rack gear portion in the connector fitting direction, a main drive gear portion of the transmission gear member provided on a side opposite to the driven gear portion with the support shaft interposed therebetween, and a second rack gear portion provided on the second housing along the connector fitting direction, and movable relative to the first housing along the connector fitting direction by rotation of the main drive gear portion.

6 Claims, 11 Drawing Sheets

(56) References Cited

U.S. PATENT DOCUMENTS

| | | | |
|---|---|---|---|
| 2007/0224862 | A1 | 9/2007 | Tyler |
| 2008/0132098 | A1 | 6/2008 | Tyler et al. |
| 2010/0227494 | A1 | 9/2010 | Tyler et al. |

FOREIGN PATENT DOCUMENTS

| | | | |
|---|---|---|---|
| JP | 2011-253655 | A | 12/2011 |
| JP | 2013-214436 | A | 10/2013 |

* cited by examiner

CONNECTOR

CROSS-REFERENCE TO RELATED APPLICATIONS

This application is based on and claims priority under 35 USC 119 from Japanese Patent Application No. 2018-129121 filed on Jul. 6, 2018, the contents of which are incorporated herein by reference.

TECHNICAL FIELD

The present invention relates to a connector.

BACKGROUND ART

As shown in FIG. 10, there has been known a lever-type connector 501 in which a lever 550 is rotatably attached to a first housing 510, the first housing 510 is shallowly fitted to a second housing 530, a cam follower 531 of the second housing 530 is made to enter an inlet of a cam groove 551 of the lever 550, and the two housings 510, 530 are fitted together due to a boosting action by rotating the lever 550 from this state to engage a track portion of the cam groove 551 with the cam follower 531 (see Patent Document 1).

However, in the lever-type connector 501, since an operation portion of the lever 550 moves in a peripheral direction around the first housing 510 in accordance with a rotation operation of the lever 550, an arc-shaped operation space is required around the first housing 510 to allow movement of the operation portion.

Since the lever-type connector 501 is a boosting mechanism by the lever 550 using a grooved cam functional portion 551, boosting effects (operation force) are different at the time of fitting and separation, and an operability is not good. That is, as shown in FIG. 11, when rotating the operation portion (a rotation end A5) of the lever 550 in a clockwise direction around a support shaft pin 511 (a rotation fulcrum B5) to fit the two housings 510, 530, a contact point C5 between a track portion 551*a* on an outer side of the cam groove 551 and the cam follower 531 is an action point of the lever 550. On the other hand, when rotating the operation portion of the lever 550 in a counterclockwise direction around the support shaft pin 511 to separate the two housings 510, 530, a contact point C6 between a track portion 551*b* on an inner side of the cam groove 551 and the cam follower 531 is an action point of the lever 550. Accordingly, a lever ratio of A5B5:B5C5 at the time of fitting and a lever ratio of A5B5:B5C6 at the time of separation are different, and the boosting effect is different at the time of fitting and separation.

Further, since the track portions of the cam groove 551 and the cam follower 531 are meshed at the contact points C5, C6 between the track portions of the cam groove 551 and the cam follower 531, respectively, strength is weak, and a contact angle varies, so that transmission of a force becomes unstable.

In addition, there is disclosed a connector that includes a first housing, a second housing including a cam follower and fittable to the first housing, a booster member rotatably provided on the first housing, a driven side engaging portion provided on the booster member along a circumference concentric with a rotation center thereof and engageable with a driving side engaging portion moving along a movement path at the time of fitting of the first housing and the second housing, and a cam functional portion formed on the booster member and engageable with the cam follower (see Patent Document 2). According to such a connector, even if an operation space is restricted, the operability can be improved.

PRIOR ART DOCUMENT

Patent Document

Patent Document 1: JP-A-2006-344473
Patent Document 2: JP-A-2011-253655

SUMMARY OF INVENTION

However, even in the connector of Patent Document 2, the first housing and the second housing are fitted and separated by a boosting action caused by engaging the cam functional portion formed on the booster member with the cam follower. Therefore, boosting effects are different at the time of fitting and separation, and an operability is unstable.

The present invention has been made in view of the above circumstances, and an object of the present invention is to provide a connector capable of reducing an operation space and improving an operability by equalizing boosting effects at the time of fitting and separation.

The object of the present invention is achieved by the following configuration.

(1) A connector including: a first housing; a second housing fittable with the first housing; a slide member movable relative to the first housing along a connector fitting direction; a transmission gear member rotatably supported by a support shaft provided on the first housing; a first rack gear portion provided on the slide member along the connector fitting direction; a driven gear portion of the transmission gear member rotated by movement of the first rack gear portion in the connector fitting direction; a main drive gear portion of the transmission gear member provided on a side opposite to the driven gear portion with the support shaft interposed therebetween; and a second rack gear portion provided on the second housing along the connector fitting direction, and movable relative to the first housing along the connector fitting direction by rotation of the main drive gear portion.

According to the connector having the configuration (1), after the first housing and the second housing are fitted and the first rack gear portion of the first housing and the second rack gear portion of the second housing are engaged in a power transmittable manner through the transmission gear member, when the slide member movable relative to the first housing is moved in the connector fitting direction, the driven gear portion of the transmission gear member pivotally supported by the first housing is rotated by the first rack gear portion provided on the slide member. By rotating the transmission gear member, the main drive gear portion provided on the side opposite to the driven gear portion moves the second rack gear portion provided on the second housing in a direction in which the second rack gear portion is fitted to the first housing. Therefore, the first housing and the second housing can be completely fitted by moving the slide member in the connector fitting direction.

Incidentally, the first rack gear portion may be directly meshed with the driven gear portion to rotate the transmission gear member, or may rotate the transmission gear member via an intermediate gear. Similarly, the main drive gear portion of the transmission gear member may be directly meshed with the second rack gear portion to move the second rack gear portion, or may move the second rack gear portion via an intermediate gear.

In addition, when the first housing and the second housing are separated, the transmission gear member is rotated in a direction opposite to that at the time of fitting by moving the slide member in a direction opposite to the connector fitting direction with respect to the first housing, so that the main drive gear portion can move the second rack gear portion provided on the second housing in a direction of separating from the first housing.

Further, since the transmission gear member is rotated by the slide member movable relative to the first housing along the connector fitting direction, there is no rotational trajectory beyond a connector size, and an operation space can be reduced, unlike a conventional lever-type connector.

The first and second rack gear portions, and the driven gear portion and the main drive gear portion of the transmission gear member transmit power by meshing teeth. Therefore, the movement is smooth and a load is shared by a plurality of teeth and contact points, which is advantageous in terms of strength. Further, even when rotation directions at the time of fitting and separation are changed, distances from a rotation center of the transmission gear member to contact points of mating teeth of the driven gear portion and the main drive gear portion, and a ratio of the contact point distance do not change, and a boosting effect does not change, so that an operability is stabilized.

(2) The connector according to the above (1), wherein a gear ratio of the driven gear portion of the transmission gear member meshing with the first rack gear portion is greater than a gear ratio of the main drive gear portion of the transmission gear member meshing with the second rack gear portion.

According to the connector having the configuration (2), the gear ratio of the driven gear portion of the transmission gear member is made larger than the gear ratio of the main drive gear portion of the transmission gear member, so that the boosting effect is generated, and a fitting work force can be reduced.

(3) The connector according to the above (1) or (2), wherein the first housing and the slide member are provided with a pair of slide locking portions that hold the slide member at an initial position by being locked to each other, and wherein the second housing is provided with a release portion configured to release locking of the pair of slide locking portions as the first housing is fitted to the second housing.

According to the connector having the configuration (3), in a state in which the first housing and the second housing are not fitted, the slide member is held at the initial position by the locking of the pair of slide locking portions. Therefore, when the two housings are fitted, the first and second rack gear portions, and the driven gear portion and the main drive gear portion of the transmission gear member can be reliably engaged with each other. Further, the locking of the pair of slide locking portions for holding the slide member at the initial position is released by a release portion as the two housings are fitted, so that a workability is good.

(4) The connector according to any one of the above (1) to (3), wherein the first housing and the transmission gear member are provided with a pair of gear locking portions that hold the transmission gear member at an initial position by being locked to each other, and wherein the transmission gear member is rotated by movement of the first rack gear portion as the slide member is mounted to the first housing, so as to release locking of the pair of gear locking portions.

According to the connector having the configuration (4), in a state in which the slide member is not mounted to the first housing, the transmission gear member is held at the initial position by the locking of the pair of gear locking portions. Therefore, when the slide member is mounted to the first housing, the first rack gear portion, and the driven gear portion of the transmission gear member can be reliably engaged with each other. In addition, the locking of the pair of gear locking portions for holding the transmission gear member at the initial position is released as the slide member is mounted to the first housing, so that the workability is good.

According to the present invention, it is possible to provide a connector capable of reducing the operation space and improving the operability by equalizing the boosting effects at the time of fitting and separation.

The present invention has been briefly described above. Further, details of the invention will be clarified by reading a mode (hereinafter, referred to as "embodiment") for carrying out the invention to be described below with reference to accompanying drawings.

BRIEF DESCRIPTION OF DRAWINGS

FIG. 5A shows a fitting start state of the first housing and the second housing, and FIG. 5B shows a state in which the fitting of the first housing and the second housing is completed;

FIG. 8A shows the fitting start state of the first housing and the second housing, and FIG. 8B shows the state in which the fitting of the first housing and the second housing is completed;

DESCRIPTION OF EMBODIMENTS

Hereinafter, an embodiment of the present invention will be described with reference to the drawings.

Figure 1:
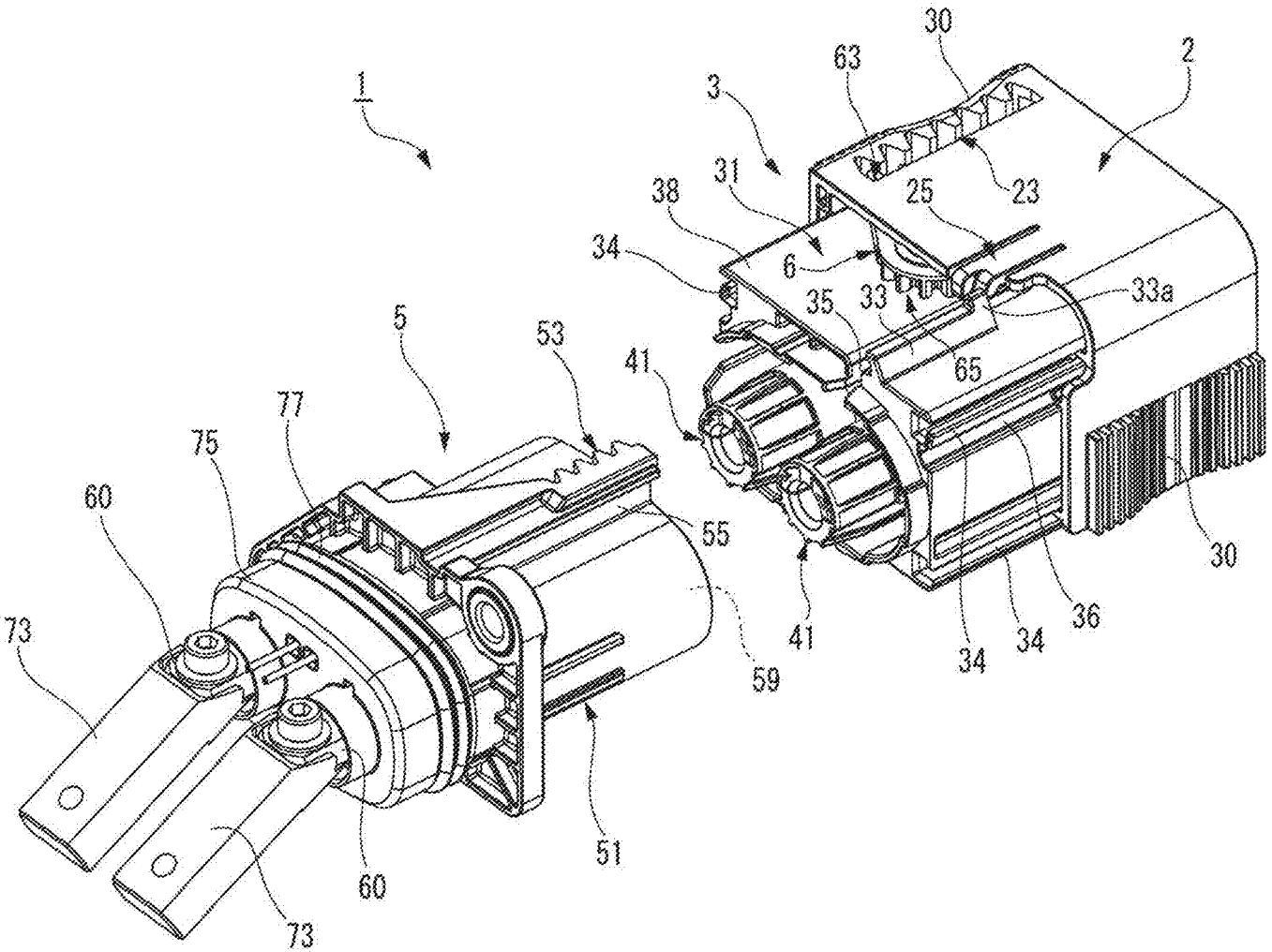
FIG. 1 is a perspective view showing a first housing and a second housing configuring a connector according to a first embodiment of the present invention.
Figure 2:
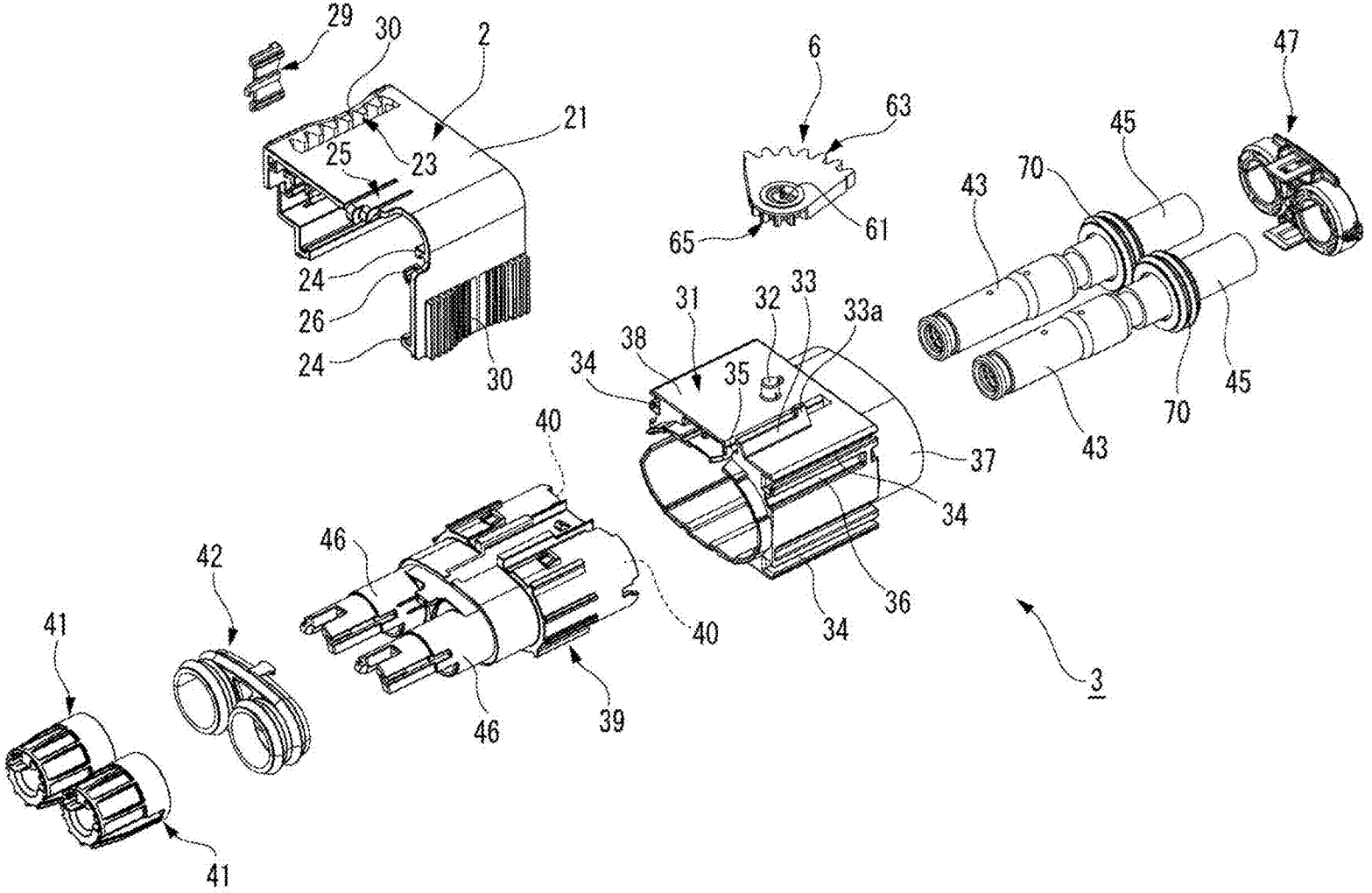
FIG. 2 is an exploded perspective view of the first housing shown in FIG. 1.
Figure 3:
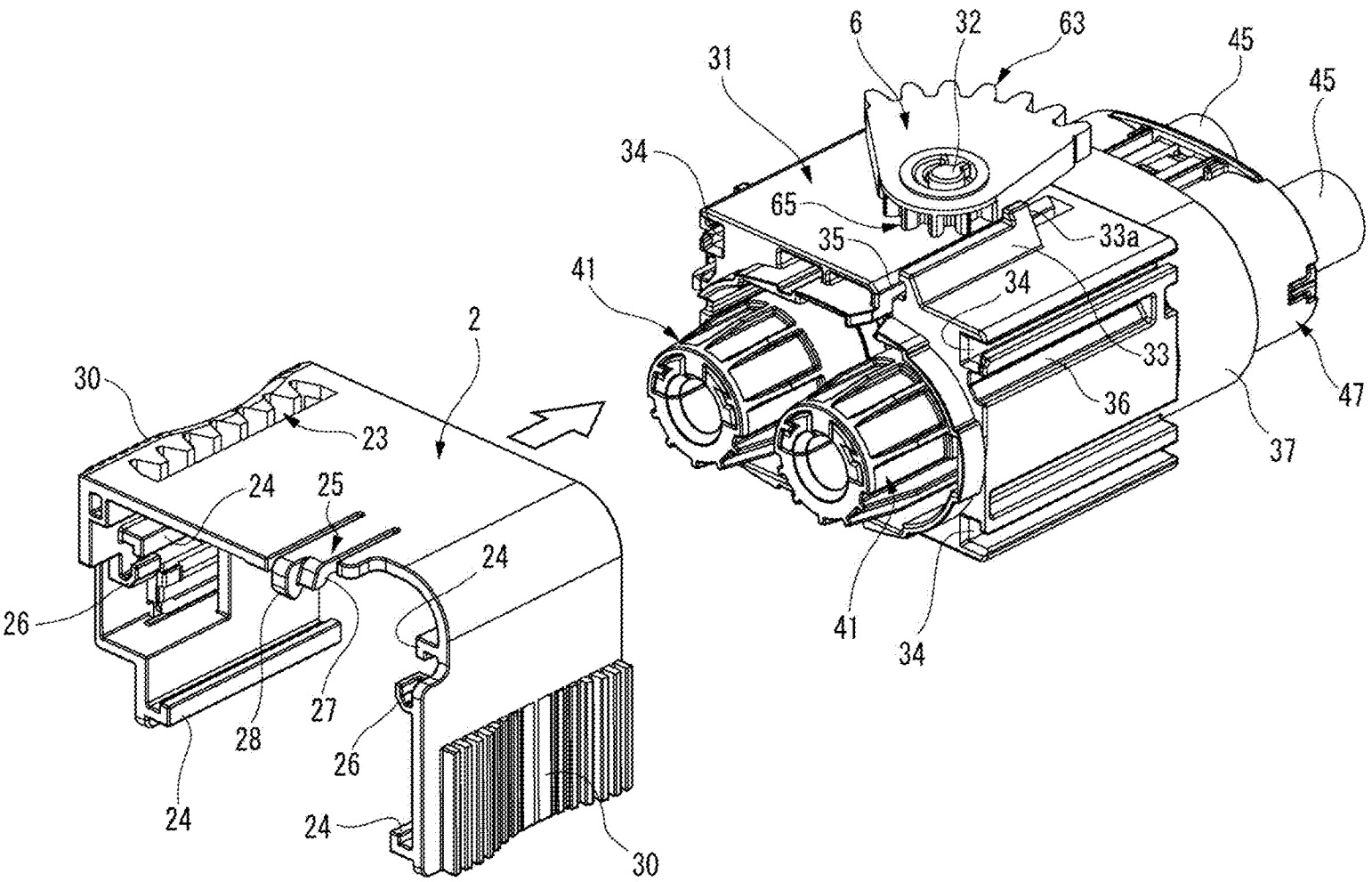
FIG. 3 is a perspective view of a state in which a slide member is removed from the first housing shown in FIG. 1.
Figure 4:
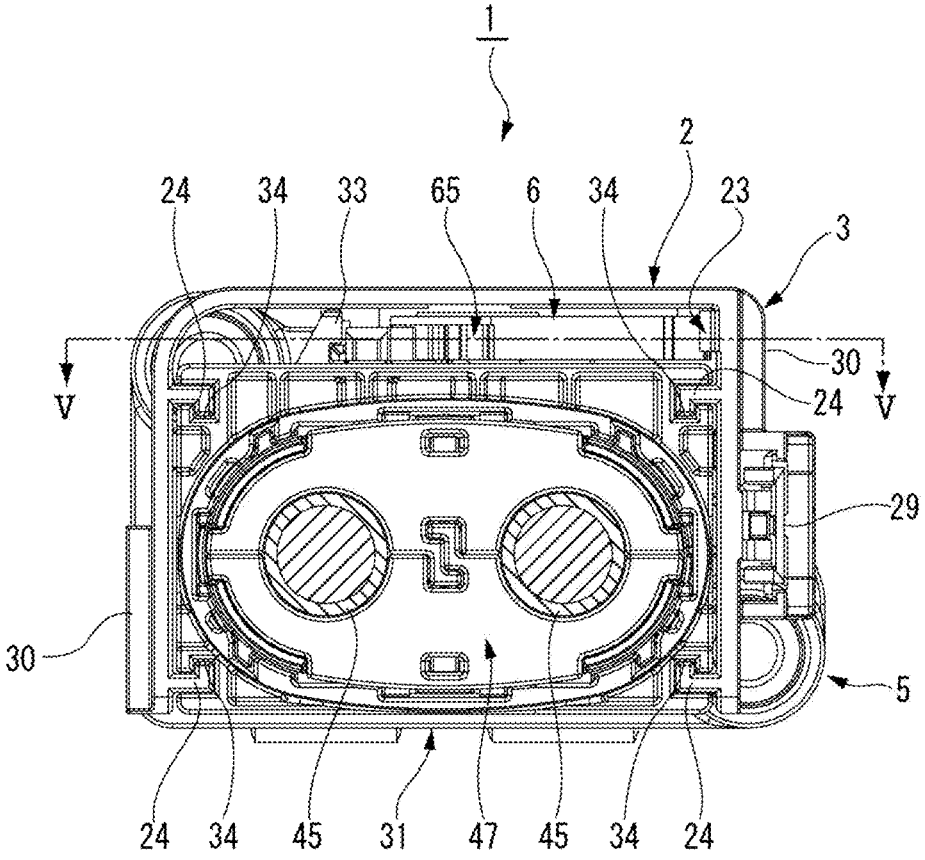
FIG. 4 is a back view of the connector shown in FIG. 1.

FIG. 1 is a perspective view showing a first housing 3 and a second housing 5 configuring a connector 1 according to a first embodiment of the present invention. FIG. 2 is an exploded perspective view of the first housing 3 shown in FIG. 1. FIG. 3 is a perspective view of a state in which a slide member 2 is removed from the first housing 3. FIG. 4 is a back view of the connector 1 shown in FIG. 1.

As shown in FIGS. 1 and 2, the connector 1 according to the first embodiment includes the first housing 3, the second housing 5, the slide member 2 movable relative to the first housing 3 along a connector fitting direction, a transmission gear member 6 rotatably pivoted by a support shaft 32 of the first housing 3, a first rack gear portion 23 provided on the slide member 2, and a second rack gear portion 53 provided on the second housing 5.

The first housing 3 and the second housing 5 are fitted and connected to each other by abutting tip end portions thereof.

As shown in FIG. 2, the first housing 3 according to the present embodiment includes an outer housing 31 and an inner housing 39 fitted to the outer housing 31. The inner housing 39 and the outer housing 31 are formed of an electrically insulating synthetic resin.

Each of female terminals 43 is formed of a conductive metal material, and is formed into a cylindrical rod shape. The female terminals 43 are accommodated in terminal accommodating chambers 40 formed on a rear side of the inner housing 39. Connection ends of the female terminals 43 accommodated in the terminal accommodating chambers 40 are engaged with guide portions 46 provided at a tip end of the inner housing 39. After a packing 42 is mounted to outer peripheries of the tip ends of the guide portions 46, front holders 41 are fixed to the tip ends of the guide portions 46. Connection holes 49 of the female terminals 43 communicate with guide holes of the guide portions 46, respectively. Male terminals 60 are insertable into the guide holes of the guide portions 46 to which the front holder 41 is fixed at the tip ends.

Figure 7:
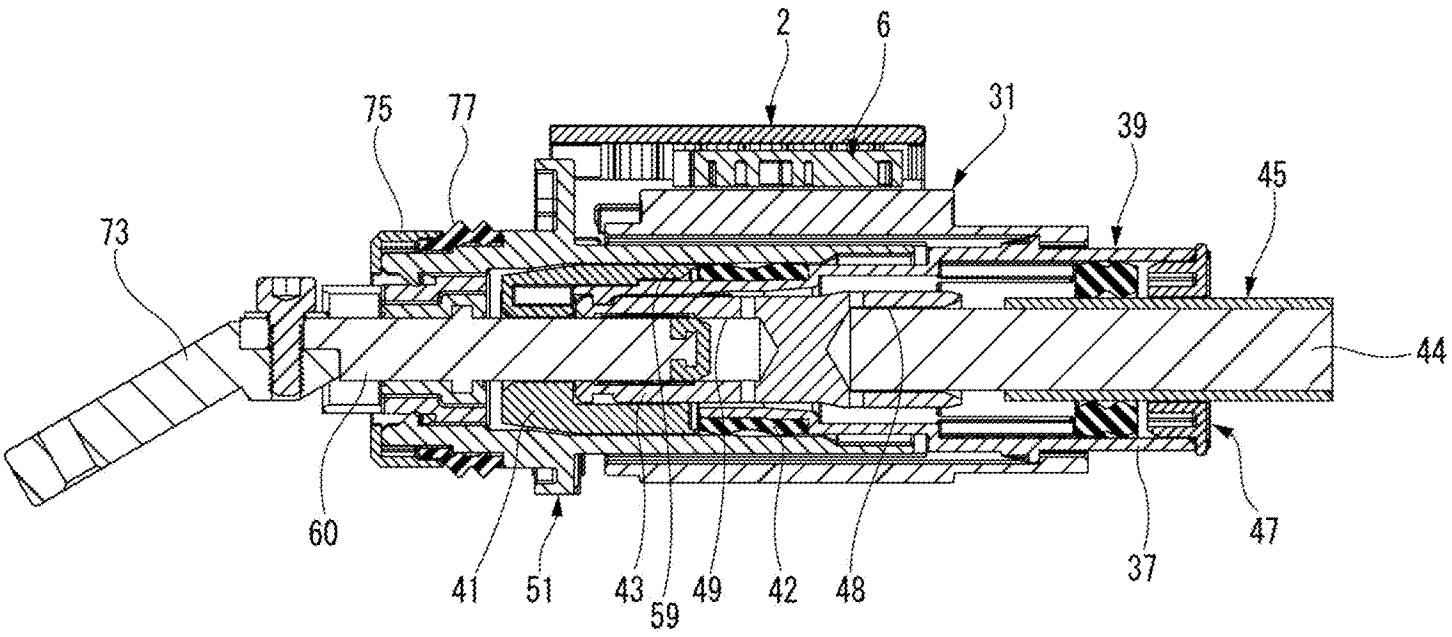
FIG. 7 is a longitudinal sectional view showing the state in which the fitting of the first housing and the second housing shown in FIG. 1 is completed.

In addition, a joining hole 48 is formed at a rear end portion of the female terminal 43, and a conductor 44 of a power feeding cable 45 drawn out from a rear end of the inner housing 39 is inserted into the joining hole 48 and is connected by caulking (see FIG. 7). Seal members 70 are mounted to the power feeding cables 45 drawn out from the rear end of the inner housing 39, and are liquid-tightly sealed with respect to the inner housing 39. The seal members 70 is restricted from being separated by a rear holder 47 mounted to the rear end of the inner housing 39.

The outer housing 31 is integrally formed with a tubular portion 37 having an elliptical cross section for accommodating the inner housing 39, and a slide support portion 38 having a rectangular cross section provided on an outer peripheral side of the tubular portion 37.

A rack insertion groove 35 extending rearward from a front end in the connector fitting direction is formed on an upper surface of the slide support portion 38, and a base portion 55 of the second rack gear portion 53, which will be described later, is inserted in the connector fitting direction. In addition, a rack guide 33 protrudes from the upper surface of the slide support portion 38 so as to extend in the connector fitting direction partway along the rack insertion groove 35. A slide locking portion 33*a* protrudes from an upper surface of a rear end of the rack guide 33 in the connector fitting direction. Further, the support shaft 32 for rotatably pivoting the transmission gear member 6 is vertically provided on the upper surface of the slide support portion 38.

On both side surfaces of the slide support portion 38, a pair of slide guide grooves 34 are recessed in the connector fitting direction along an upper surface side and a lower surface side, respectively. In addition, slide restriction grooves 36 extending rearward from the front end in the connector fitting direction are recessed on the both side surfaces of the slide support portion 38. Rear end sides of the slide restriction grooves 36 in the connector fitting direction does not communicate with a back surface of the slide support portion 38, and have dead ends.

The transmission gear member 6 rotatably supported by the support shaft 32 of the outer housing 31 is formed in a substantially fan shape, and includes a shaft hole 61 pivotally supported by the support shaft 32, a driven gear portion 63 meshing with the first rack gear portion 23, and a main drive gear portion 65 provided on a side opposite to the driven gear portion 63 with the support shaft 32 interposed therebetween and meshing with the second rack gear portion 53. Herein, a gear ratio of the driven gear portion 63 is larger than that of the main drive gear portion 65.

The second housing 5 is formed of an electrically insulating synthetic resin, and includes a hood portion 51. A pair of fitting holes 59 having a circular cross section are formed inside the hood portion 51, and the male terminals 60 are provided at centers of the fitting holes 59 along an axial direction of the fitting holes 59.

Each of connecting rods 73 formed of a conductive metal material is provided at a rear portion of the second housing 5. The connecting rods 73 are connected to the male terminals 60 projecting from a rear end of the second housing 5, and are connected to a circuit such as a power source. A packing 77 is mounted on an outer peripheral surface of a rear portion of the second housing 5, and the packing 77 is restricted from being separated by a rear holder 75.

The second rack gear portion 53 extending rearward from the front end in the connector fitting direction is provided on an upper surface of the second housing 5. The second rack gear portion 53 of the second housing 5 is formed at an upper end of the base portion 55 extending along a connector fitting direction of the hood portion 51. Therefore, when the second housing 5 is fitted to the first housing 3, the second rack gear portion 53 can project on the upper surface of the slide support portion 38 of the outer housing 31 via the rack insertion groove 35, and can mesh with the main drive gear portion 65 of the transmission gear member 6.

As shown in FIGS. 2 and 3, the slide member 2 is a frame body having a U-shaped cross section having three planes that substantially covers the upper surface and both side surfaces of the slide support portion 38 of the outer housing 31. The first rack gear portion 23 is formed on an inner wall surface at one internal corner portion of the slide member 2 along the connector fitting direction. On both inner wall surfaces of the slide member 2, slide guide rails 24 that are respectively slidably fitted corresponding to the slide guide grooves 34 recessed on the both side surfaces of the slide support portion 38 protrude along the connector fitting direction. In addition, slide protrusions 26 that are slidably fitted corresponding to the slide restriction grooves 36 recessed on the both side surfaces of the slide support portion 38 protrude on front end portions in the connector fitting direction on the both inner wall surfaces of the slide member 2.

A slide locking portion 25 including a flexible arm formed by a pair of slits extending rearward from the front end in the connector fitting direction is formed on an upper wall of the slide member 2. At a free end of the slide locking portion 25, a stopper protrusion 27 and an abutting protrusion 28 are provided so as to project downward from the upper wall.

Further, a plurality of anti-slip ribs 30 extending in a direction intersecting the connector fitting direction are projectingly provided on the both outer wall surfaces of the slide member 2. In addition, a slider 29 configuring a fitting guarantee mechanism of the slide member 2 is disposed on one side wall of the slide member 2.

As shown in FIG. 3, the slide member 2 is inserted from the front of the connector of the outer housing 31 so that the slide guide rails 24 are respectively fitted to the slide guide grooves 34 of the slide support portion 38.

When the slide member 2 is inserted into a predetermined amount, the stopper protrusion 27 of the slide locking portion 25 abuts against the slide locking portion 33*a* of the rack guide 33, but the stopper protrusion 27 can pass through the slide locking portion 33*a* by the sliding locking portion 25 being elastically deformed upward due to an action of an inner tapered surface.

As shown in FIG. 1, when the slide protrusions 26 slidably fitted to the slide restriction grooves 36 reaches rear ends of the slide restriction grooves 36, the slide member 2 is restricted from moving backward in the connector fitting direction. In addition, when the slide member 2 is moved forward in the connector fitting direction, the stopper protrusion 27 of the slide locking portion 25 abuts against the slide locking portion 33*a,* but the slide locking portion 25 cannot be elastically deformed upward by the action of the inner tapered surface, and movement of the slide member 2 is restricted. Therefore, the slide member 2 is held at an initial position with respect to the first housing 3 by the locking of the pair of slide locking portions 25, 33*a*.

The first housing 3 to which the slide member 2 is mounted as described above and the second housing 5 can be fitted to each other by abutting the tip end portions thereof.

Figure 5A:
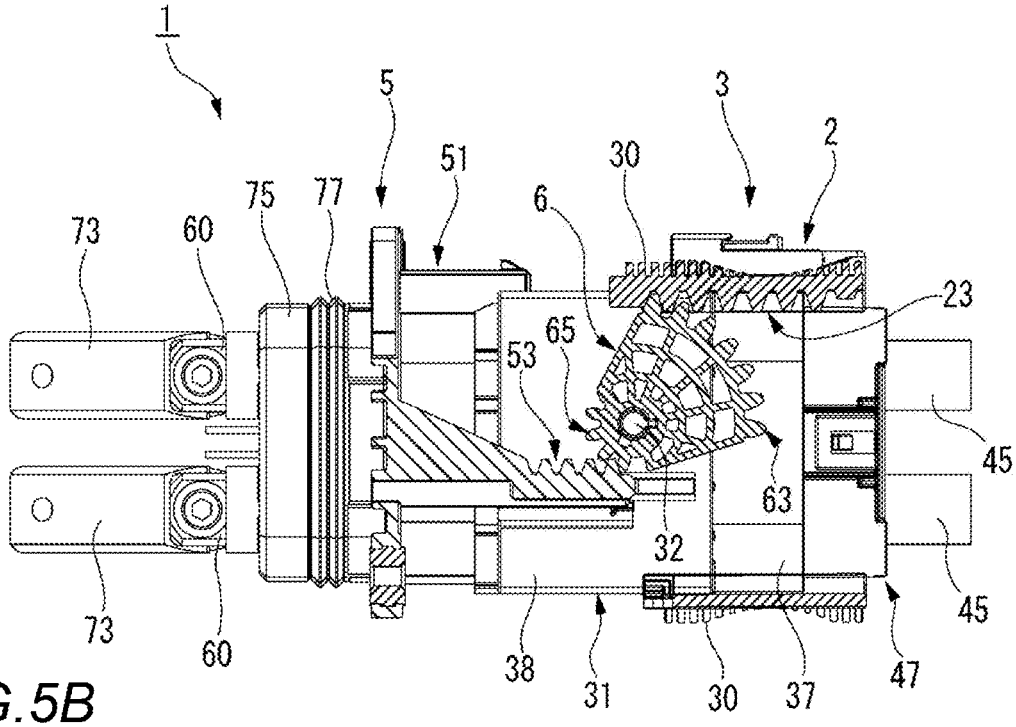
FIGS. 5A and 5B are sectional views taken along a line V-V in FIG. 4.

As shown in FIG. 5A, when the first housing 3 and the second housing 5 of the connector 1 according to the present embodiment are fitted, the first housing 3 and the second housing 5 are slightly fitted, and the main drive gear portion 65 of the transmission gear member 6 is engaged with the second rack gear portion 53 of the second housing 5.

At this time, a tip end portion of the second rack gear portion 53 of which the base portion 55 is inserted and guided into the rack insertion groove 35 of the slide support portion 38 abuts against the abutting protrusion 28 of the slide locking portion 25 as a release portion, and the slide locking portion 25 is elastically deformed upward. Therefore, the stopper protrusion 27 formed on the slide locking portion 25 also moves upward, and movement restriction of the slide member 2 by the slide locking portion 33*a* is released. Accordingly, the slide member 2 can be moved forward in the connector fitting direction.

Figure 5B:
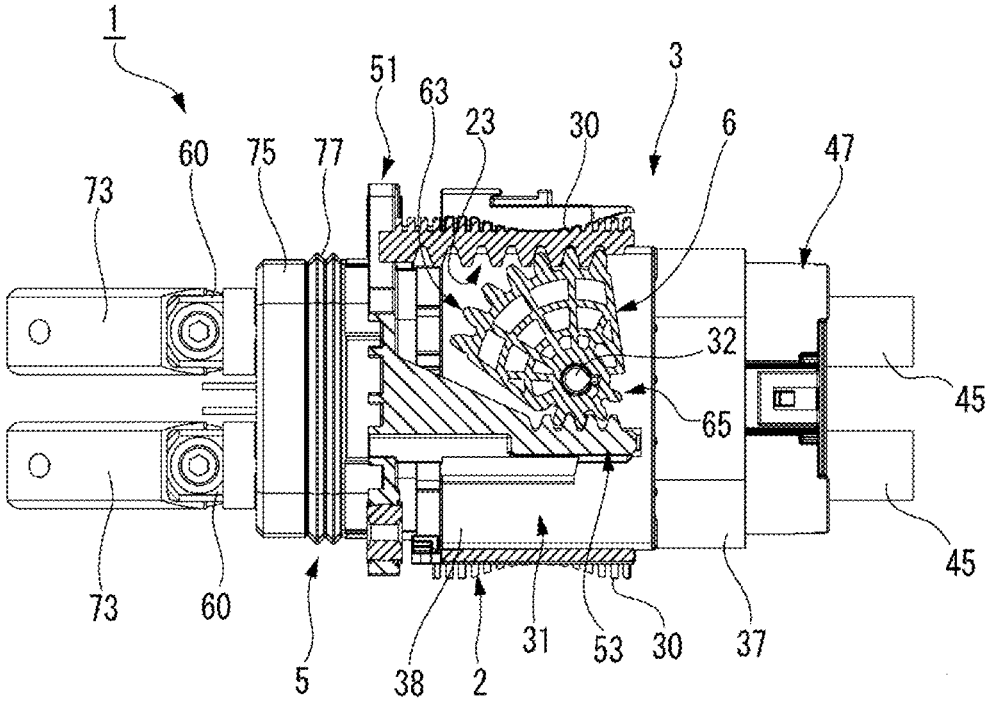
Figure 6:
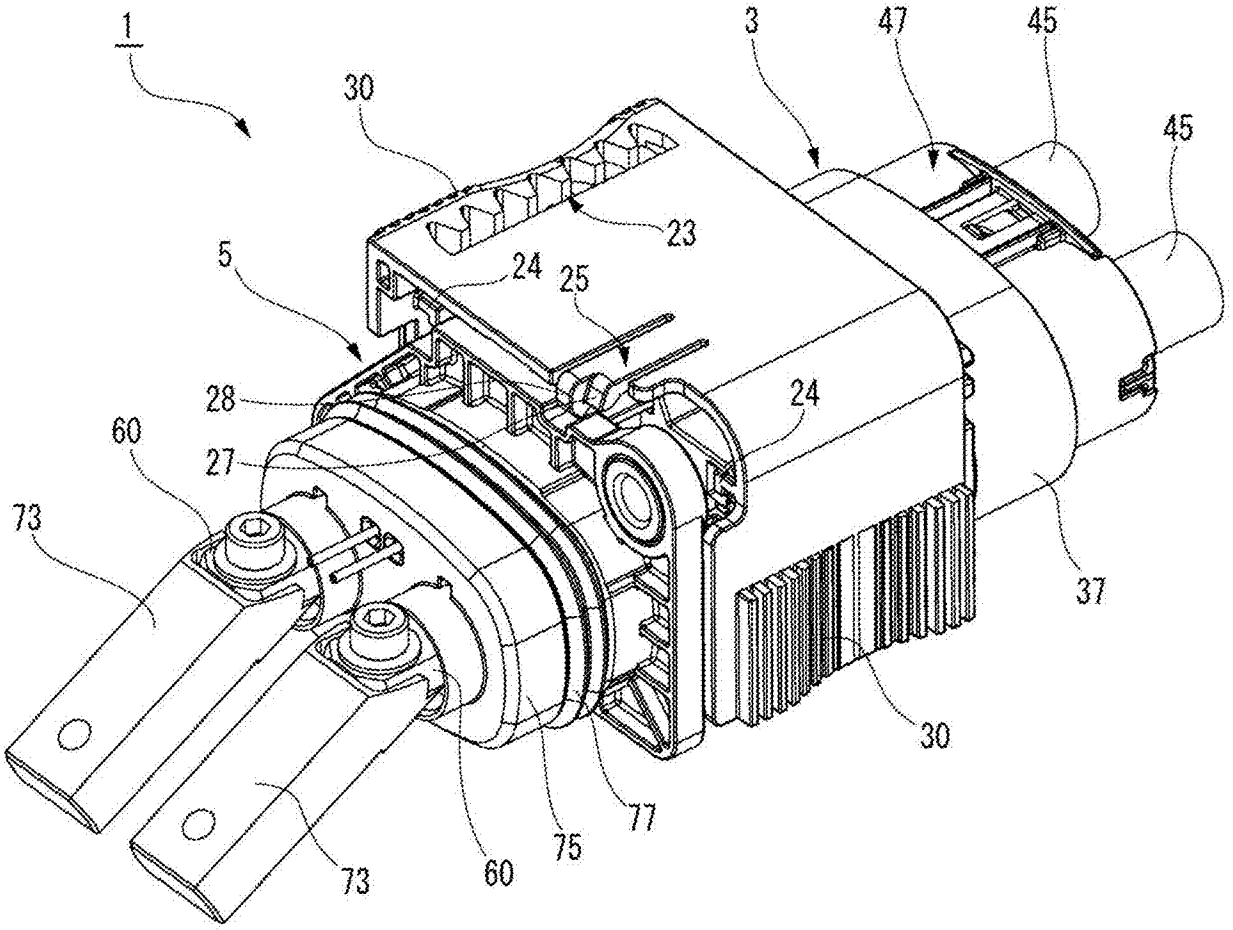
FIG. 6 is a perspective view showing the state in which the fitting of the first housing and the second housing shown in FIG. 1 is completed.

When the slide member 2 movable relative to the first housing 3 is moved in the connector fitting direction (a left direction in FIGS. 5A and 5B), the driven gear portion 63 of the transmission gear member 6 pivotally supported by the first housing 3 is rotated in a counterclockwise direction in FIGS. 5A and 5B by the first rack gear portion 23 provided on the slide member 2.

By rotating the transmission gear member 6, the main drive gear portion 65 provided on the side opposite to the driven gear portion 63 moves the second rack gear portion 53 provided on the second housing 5 in a direction in which the second rack gear portion 53 is fitted to the first housing 3 (a right direction in FIGS. 5A and 5B).

Therefore, as shown in FIG. 5A, the first housing 3 and the second housing 5 can be completely fitted by moving the slide member 2 in the connector fitting direction.

When the first housing 3 and the second housing 5 are separated, the transmission gear member 6 is rotated in a direction opposite to that at the time of fitting by moving the slide member 2 in a direction opposite to the connector fitting direction with respect to the first housing 3, so that the main drive gear portion 65 can move the second rack gear portion 53 provided on the second housing 5 in a direction of separating from the first housing 3.

Figure 10:
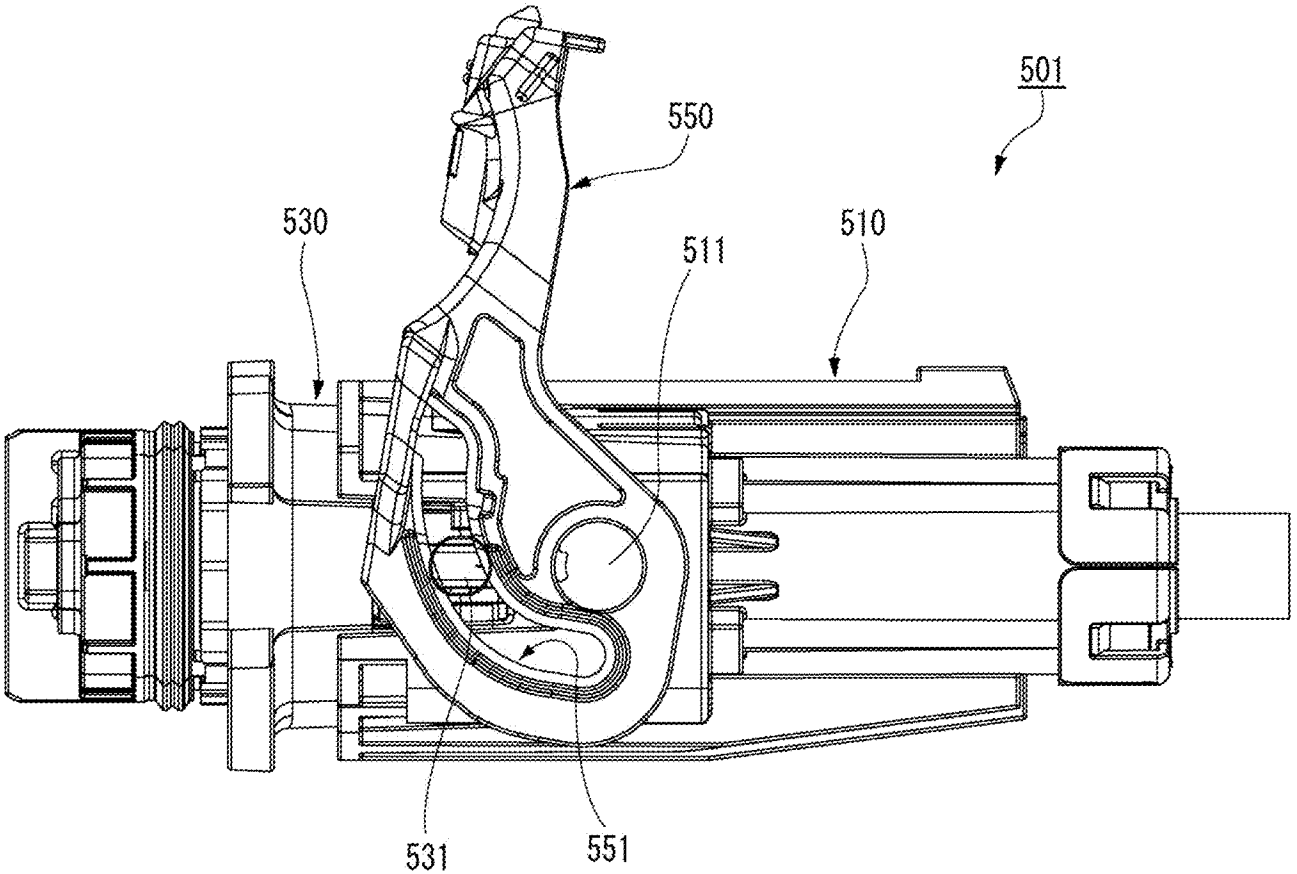
FIG. 10 is a side view of a conventional lever-type connector.
Figure 11:
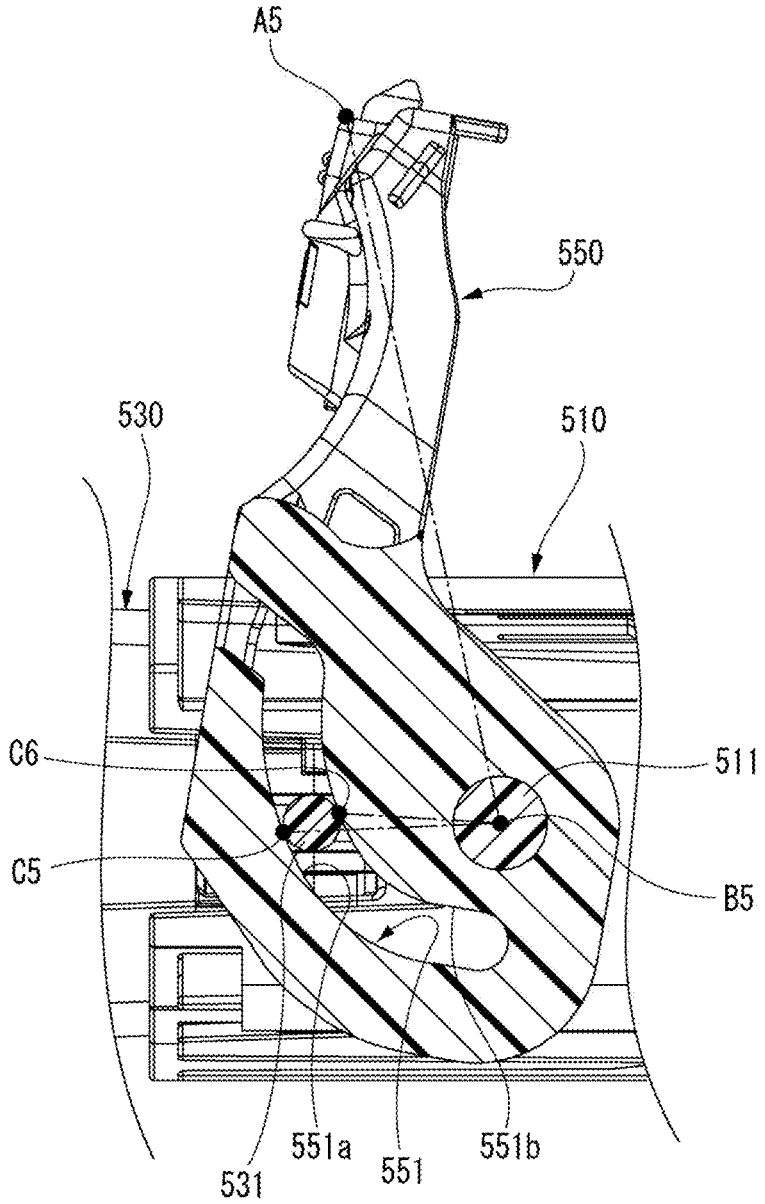
FIG. 11 is an enlarged sectional view of a main part for explaining a boosting effect of a lever shown in FIG. 10.

Further, since the transmission gear member 6 is rotated by the slide member 2 movable relative to the first housing 3 along the connector fitting direction, there is no rotational trajectory beyond a connector size, and an operation space can be reduced, unlike a conventional lever-type connector 501 shown in FIG. 10.

The first and second rack gear portions 23, 53, and the driven gear portion 63 and the main drive gear portion 65 of the transmission gear member 6 transmit power by meshing teeth. Therefore, the movement is smooth and a load is shared by a plurality of teeth and contact points, which is advantageous in terms of strength.

Figure 8A:
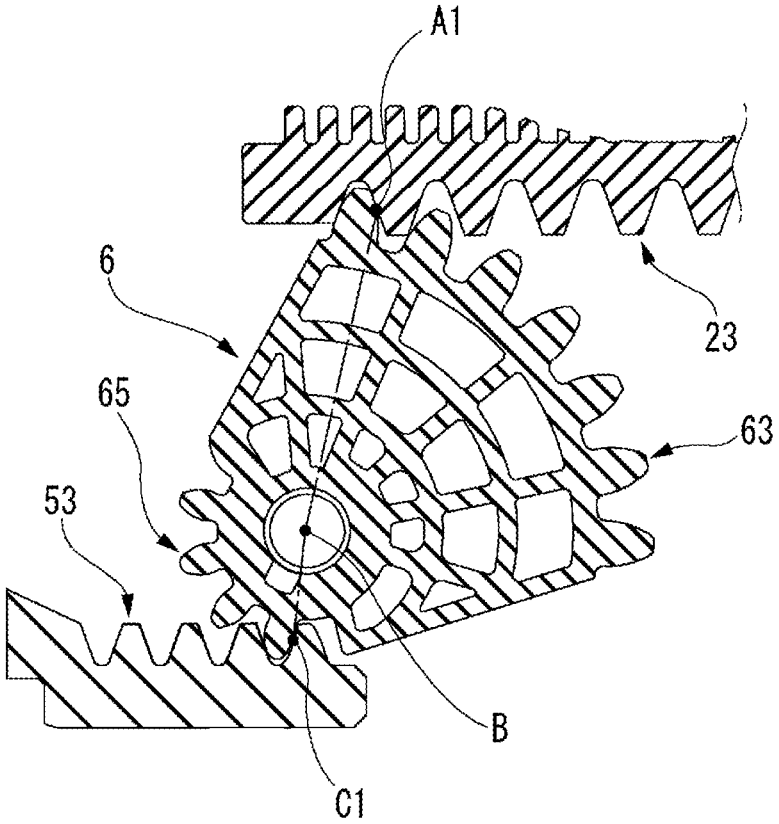
FIGS. 8A and 8B are sectional views of a main part for explaining a meshing state of first and second rack gear portions, and a driven gear portion and a main drive gear portion of a transmission gear member.
Figure 8B:
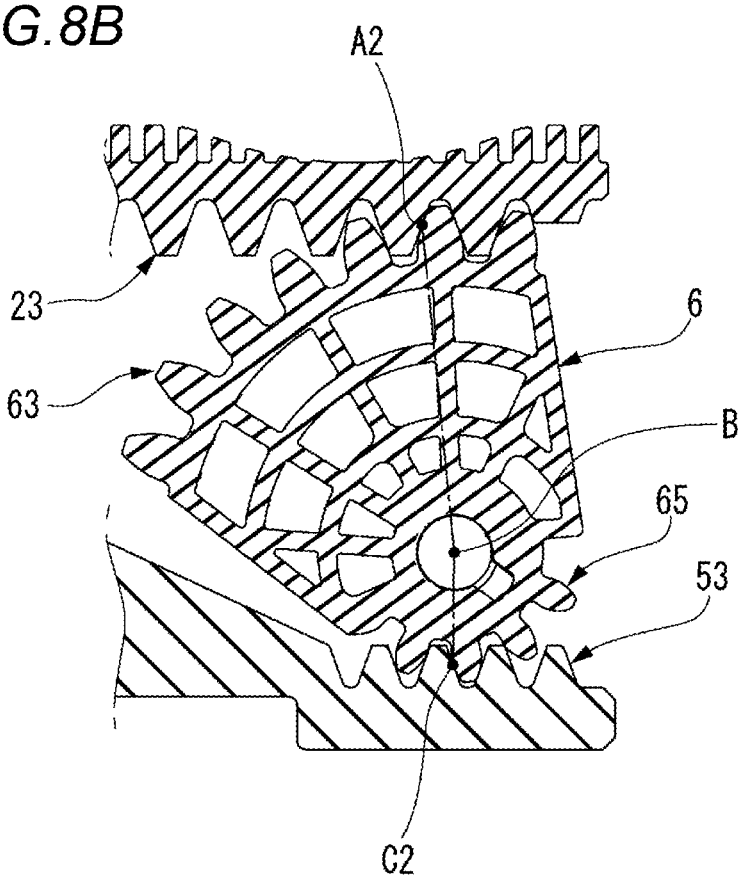

Further, a distance from a rotation center B of the transmission gear member 6 to a contact point A1 of a mating tooth of the first rack gear portion 23 and the driven gear portion 63 at the time of fitting shown in FIG. 8A and a distance from the rotation center B of the transmission gear member 6 to a contact point A2 of a mating tooth of the first rack gear portion 23 and the driven gear portion 63 at the time of separation shown in FIG. 8B do not change. In addition, a distance from the rotation center B of the transmission gear member 6 to a contact point C1 of a mating tooth of the second rack gear portion 53 and the main drive gear portion 65 at the time of fitting shown in FIG. 8A and a distance from the rotation center B of the transmission gear member 6 to a contact point C2 of a mating tooth of the second rack gear portion 53 and the main drive gear portion 65 at the time of separation shown in FIG. 8B do not change. Therefore, even when a rotation direction of the transmission gear member 6 is changed, a ratio of the contact point distance does not change, and a boosting effect does not change, so that an operability is stabilized.

Further, according to the connector 1 according to the first embodiment, the gear ratio of the driven gear portion 63 of the transmission gear member 6 is made larger than the gear ratio of the main drive gear portion 65 of the transmission gear member 6, so that the boosting effect is generated, and a fitting work force can be reduced.

In addition, according to the connector 1 according to the first embodiment, in a state in which the first housing 3 and the second housing 5 are not fitted, the slide member 2 is held at the initial position by the locking of the pair of slide locking portions 25, 33*a*. Therefore, when the two housings 3, 5 are fitted, the first and second rack gear portions 23, 53 and the driven gear portion 63 and the main drive gear portion 65 of the transmission gear member 6 can be reliably engaged with each other. Further, the locking of the pair of slide locking portions 25. 33*a* for holding the slide member 2 at the initial position is released by the tip end portion of the second rack gear portion 53 that is the release portion as the two housings are fitted, so that a workability is good.

Figure 9A:
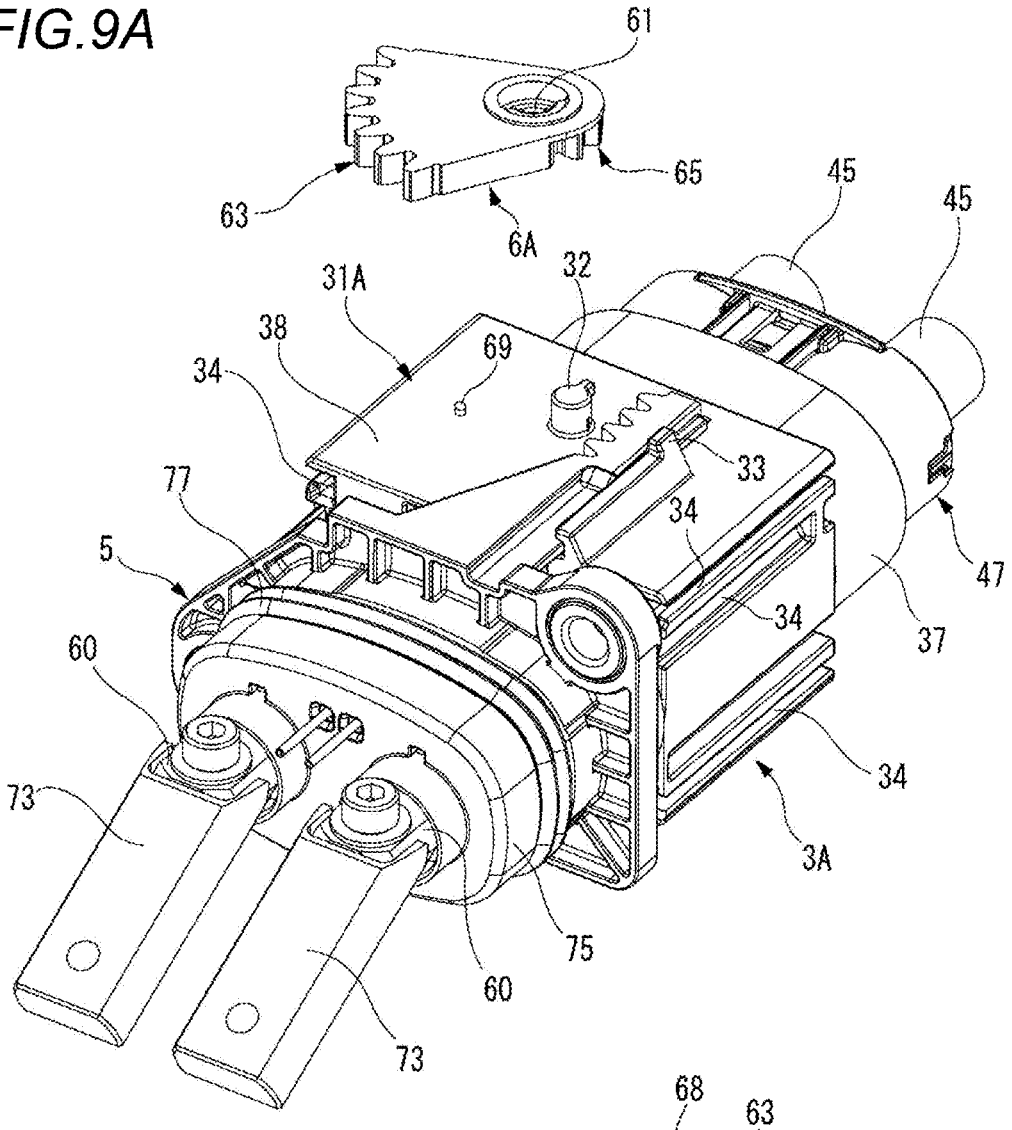
FIG. 9A is an exploded perspective view of a main part of a connector according to a second embodiment of the present invention.
Figure 9B:
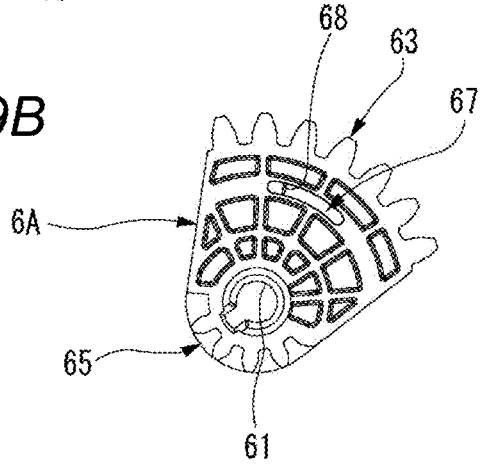
FIG. 9B is a bottom view of a transmission gear member shown in FIG. 9A.

FIG. 9A is an exploded perspective view of a main part of a connector according to a second embodiment of the present invention, and FIG. 9B is a bottom view of a transmission gear member 6A shown in FIG. 9A. Incidentally the same components as those of the connector 1 of the first embodiment will be denoted by the same reference numerals, and a detailed description thereof will be omitted.

As shown in FIGS. 9A and 9B, a first housing 3A and a transmission gear member 6A are provided with a pair of gear locking portions 67, 69 that hold the transmission gear member 6A at an initial position by being locked to each other.

The gear locking portion 67 is an arc groove provided on a bottom surface of the transmission gear member 6A facing the upper surface of the slide support portion 38. A position restriction rib 68 is projectingly provided at the bottom of the arc groove.

The gear locking portion 69 is a locking protrusion vertically provided on the upper surface of the slide support portion 38 on an outer housing 31A corresponding to the gear locking portion 67 of the transmission gear member 6A pivotally supported by the support shaft 32. In a case in which a predetermined value or more of a rotation force is applied to the transmission gear member 6A, an engagement state between the position restriction rib 68 on the gear locking portion 67 and the locking protrusion of the gear locking portion 69 is appropriately set to be releasable.

When the gear locking portion 69 is positioned at an initial position region defined by the position restriction rib 68, rotation of the transmission gear member 6A is restricted and held at the initial position.

When the transmission gear member 6A is rotated by the movement of the first rack gear portion 23 with a predetermined force or more as the slide member 2 is mounted to the first housing 3A, the position restriction rib 68 gets over the gear locking portion 69, so that the locking of the pair of gear locking portions 67, 69 is released.

In a state in which the slide member 2 is not mounted to the first housing 3A, the transmission gear member 6A is held at the initial position by the locking of the pair of gear locking portions 67, 69. Therefore, when the slide member 2 is mounted to the first housing 3A, the first rack gear portion 23 and the driven gear portion 63 of the transmission gear member 6A can be reliably engaged with each other. In addition, the locking of the pair of gear locking portions 67, 69 for holding the transmission gear member 6A at the initial position is released as the slide member 2 is mounted to the first housing 3A, so that the workability is good.

According to the connector 1 of the present embodiment described above, the operation space can be reduced, and an operability can be improved by equalizing the boosting effects at the time of fitting and separation.

Incidentally, the present invention is not limited to the embodiments described above, and may be appropriately modified, improved, or the like. In addition, materials, shapes, dimensions, numbers, disposition locations, or the like of constituent elements in the above-described embodiments are arbitrary and are not limited as long as the present invention can be achieved.

For example, in the above embodiment, the first rack gear portion 23 is configured to be meshed directly with the driven gear portion 63 to rotate the transmission gear member 6, but may be configured to rotate the transmission gear member via an intermediate gear. Similarly, the main drive gear portion 65 of the transmission gear member 6 is configured to be directly meshed with the second rack gear portion 53 to move the second rack gear portion 53, but may be configured to move the second rack gear portion via an intermediate gear.

Further, characteristics of the embodiments of the connector according to the present invention described above are briefly summarized in the following [1] to [4], respectively.

[1] A connector (1) including:

a first housing (3);

a second housing (5) fittable with the first housing;

a slide member (2) movable relative to the first housing along a connector fitting direction;

a transmission gear member (6) rotatably supported by a support shaft (32) provided on the first housing;

a first rack gear portion (23) provided on the slide member along the connector fitting direction;

a driven gear portion (63) of the transmission gear member rotated by movement of the first rack gear portion in the connector fitting direction;

a main drive gear portion (65) of the transmission gear member provided on a side opposite to the driven gear portion with the support shaft interposed therebetween; and a second rack gear portion (53) provided on the second housing along the connector fitting direction, and movable relative to the first housing along the connector fitting direction by rotation of the main drive gear portion.

[2] The connector (1) according to [1], wherein a gear ratio of the driven gear portion (63) of the transmission gear member (6) meshing with the first rack gear portion (23) is greater than a gear ratio of the main drive gear portion (65) of the transmission gear member (6) meshing with the second rack gear portion (53).

[3] The connector (1) according to [1] or [2], wherein the first housing (3) and the slide member (2) are provided with a pair of slide locking portions (25, 33*a*) that hold the slide member (2) at an initial position by being locked to each other, and wherein the second housing (5) is provided with a release portion (a tip end portion of the second rack gear portion 53) configured to release locking of the pair of slide locking portions as the first housing (3) is fitted to the second housing.

[4] The connector according to any one of [1] to [3], wherein the first housing (3A) and the transmission gear member (6A) are provided with a pair of gear locking portions (67, 69) that hold the transmission gear member (6A) at an initial position by being locked to each other, and wherein the transmission gear member is rotated by movement of the first rack gear portion as the slide member (2) is mounted to the first housing, so as to release locking of the pair of gear locking portions.

What is claimed is:

1. A connector comprising:

a first housing;

a second housing fittable with the first housing;

a slide member movable relative to the first housing along a connector fitting direction;

a fan-shaped transmission gear member rotatably supported by a support shaft vertically provided on the first housing in a direction perpendicular to the connector fitting direction and a connector width direction, the connector width direction being perpendicular to the connector fitting direction;

a first rack gear portion is formed in the slide member along the connector fitting direction;

a driven gear portion is formed on the transmission gear member rotated by movement of the first rack gear portion in the connector fitting direction;

a main drive gear portion of the transmission gear member is formed on a side opposite to the driven gear portion with the support shaft interposed therebetween; and a second rack gear portion is formed on the second housing along the connector fitting direction, and movable relative to the first housing along the connector fitting direction by rotation of the main drive gear portion.

2. The connector according to claim 1, wherein a gear ratio of the driven gear portion of the transmission gear member meshing with the first rack gear portion is greater than a gear ratio of the main drive gear portion of the transmission gear member meshing with the second rack gear portion.

3. The connector according to claim 1, wherein the first housing and the slide member are provided with a pair of slide locking portions that hold the slide member at an initial position by being locked to each other, and the second housing is provided with a release portion that releases locking of the pair of slide locking portions as the first housing is fitted to the second housing.

4. The connector according to claim 1, wherein the first housing and the transmission gear member are provided with a pair of gear locking portions that hold the transmission gear member at an initial position by being locked to each other, and the transmission gear member is rotated by movement of the first rack gear portion as the slide member is mounted to the first housing, so as to release locking of the pair of gear locking portions.

5. The connector according to claim 3, wherein the pair of slide locking portions arranged on the slide member includes a flexible arm formed by a pair of slits extending rearward from a front end of the pair of slide locking portions in the connector fitting direction, and a stopper protrusion and an abutting protrusion are provided at a free end of the pair of slide locking portions.

6. The connector according to claim 4, wherein the pair of gear locking portions is an arc groove provided on a bottom surface of the transmission gear member and a locking protrusion vertically provided on an upper surface of the first housing corresponding to the arc groove, respectively, and a position restriction rib is projectingly provided at a bottom of the arc groove.

* * * * *